US006848375B2

(12) United States Patent
Kasin

(10) Patent No.: US 6,848,375 B2
(45) Date of Patent: Feb. 1, 2005

(54) METHOD AND DEVICE FOR COMBUSTION OF SOLID FUEL

(75) Inventor: Sigvart Kasin, Notodden (NO)

(73) Assignee: Organic Power ASA, Oslo (NO)

( * ) Notice: Subject to any disclaimer, the term of this patent is extended or adjusted under 35 U.S.C. 154(b) by 0 days.

(21) Appl. No.: 10/239,458

(22) PCT Filed: Mar. 23, 2001

(86) PCT No.: PCT/NO01/00130

§ 371 (c)(1),
(2), (4) Date: Jan. 3, 2003

(87) PCT Pub. No.: WO01/71253

PCT Pub. Date: Sep. 27, 2001

(65) Prior Publication Data

US 2004/0035339 A1 Feb. 26, 2004

(30) Foreign Application Priority Data

Mar. 24, 2000 (NO) ..... 20001571

(51) Int. Cl.[7] ..... F23B 5/04; F23C 9/00; F23N 5/00

(52) U.S. Cl. ..... 110/346; 110/204; 110/208; 110/223; 110/185

(58) Field of Search ..... 110/185, 203, 110/204, 205, 206, 207, 208, 210, 211, 212, 213, 214, 218, 219, 223, 346

(56) References Cited

U.S. PATENT DOCUMENTS

| | | | | |
|---|---|---|---|---|
| 4,123,979 A | | 11/1978 | Tesch | 110/212 |
| 4,167,909 A | | 9/1979 | Dauvergne | 110/207 |
| 4,378,208 A | | 3/1983 | Payne et al. | 432/14 |
| 4,395,956 A | | 8/1983 | Hand, Jr. et al. | 110/235 |
| 4,474,121 A | | 10/1984 | Lewis | 110/346 |
| 4,531,462 A | | 7/1985 | Payne | 110/210 |
| 4,538,529 A | | 9/1985 | Temelli | 110/244 |
| 4,793,974 A | | 12/1988 | Hebrank | 422/175 |
| 4,869,181 A | | 9/1989 | Pike | 110/211 |
| 5,060,584 A | | 10/1991 | Sowards et al. | 110/245 |
| 5,158,025 A | | 10/1992 | Johnson | 110/235 |
| 5,222,446 A | | 6/1993 | Edwards et al. | 110/235 |
| 5,269,235 A | * | 12/1993 | McGill et al. | 110/246 |
| 5,279,234 A | * | 1/1994 | Bender et al. | 110/210 |
| 5,307,746 A | * | 5/1994 | Khinkis et al. | 110/245 |
| 5,374,403 A | | 12/1994 | Chang | 422/168 |
| 5,520,123 A | | 5/1996 | Chappell et al. | 110/188 |
| 5,826,521 A | * | 10/1998 | Schumann et al. | 110/345 |
| RE35,990 E | | 12/1998 | Greene et al. | 110/345 |
| 5,901,653 A | | 5/1999 | Jennebach et al. | 110/213 |

FOREIGN PATENT DOCUMENTS

| | | | | |
|---|---|---|---|---|
| EP | 0409790 | | 1/1991 | F23N/5/00 |
| GB | 1535330 | | 12/1978 | F23B/5/04 |
| GB | 2226122 A | * | 6/1990 | F23L/7/00 |
| WO | 9624804 | | 8/1996 | F23J/11/00 |

* cited by examiner

*Primary Examiner*—Kenneth Rinehart
(74) *Attorney, Agent, or Firm*—Thompson Coburn LLP

(57) ABSTRACT

This invention relates to a method and device for converting energy by combustion of solid fuel, especially incineration of bio-organic fuels and municipal solid waste to produce heat energy and which operates with very low levels of $NO_x$, CO and fly ash, in which that the oxygen flow in the first and second combustion chambers in at least one separate zone and by sealing off the entire combustion chambers in order to eliminate penetration of false air into the chambers, the temperatures in the first and second combustion chamber are strictly controlled, in addition to the regulation of the oxygen flow, by admixing a regulated amount of recycled flue gas with the fresh air which is being led into each of the chambers in each of the at least one separate zones, and both the recycled flue gas and fresh combustion gases are filtered in unburned solid waste in the first combustion chamber by sending the unburned solid waste and the gases in a counter-flow before entering the gases into the second combustion chamber.

18 Claims, 9 Drawing Sheets

METHOD AND DEVICE FOR COMBUSTION OF SOLID FUEL

This invention relates to a method and device for converting energy by combustion of solid fuel, especially incineration of bio-organic fuels and municipal solid waste to produce heat energy and which operates with very low levels of $NO_x$, CO and fly ash.

BACKGROUND

The industrialised way of living produces enormous amounts of solid municipal waste and other forms of solid waste such as for instance rubber tyres, construction materials etc. The vast amounts of these solid wastes have in many highly populated areas grown into a major pollution problem simply due to its volume which has consumed major parts of the available deposition capacity in the area. In addition, there are often strong restrictions to deposition places since major parts of this waste is only slowly biodegradable and do often contain toxic substances.

One very effective way of reducing the volume and weight of solid municipal waste, and which also may destroy many toxic substances, is to burn it in incinerators. This may reduce the volume of uncompacted waste up to 90% leaving an inert residue ash, glass, metal and other solid materials called bottom ash which may be deposited in a landfill. If the combustion process is carefully controlled, the combustible part of the waste will be transformed to mostly $CO_2$, $H_2O$ and heat.

Municipal waste is a mixture of many different materials with a wide variety of combustion properties. Thus, in practice there will always be some degree of incomplete combustion involved in solid waste incinerators which produce gaseous by-products such as for instance CO and finely divided particulate material called fly ash. Fly ash includes cinders, dust and soot. In addition there are also difficulties in controlling the temperature in the incinerator so carefully that one has a sufficiently high temperature to achieve an acceptable degree of combustion of the waste, but low enough to avoid the formation of $NO_x$.

In order to avoiding these compounds from reaching the atmosphere, modern incinerators must be equipped with extensive emission-control devices including fabric baghose filters, acid gas scrubbers, electrostatic precipitators etc. These emission-control devices introduces substantial additional costs to the process, and as result, waste incinerators with state of the art emission control are normally up-scaled to capacities of delivering 30–300 MW of heat energy in form of hot water or steam. Such enormous plants require very large amounts of municipal waste (or other fuels) and do also often include very extensive pipelines to deliver the heat energy to numerous customers spread over a wide area. Thus this solution is only suited for major cities and other large heavily populated areas.

For smaller plants, there has presently not been possible to obtain the same degree of emission-control due to the investment and operation costs of the emission-control devices. Presently, this has resulted in more generous emission permits for smaller waste incineration plants which produce less than 30 MW of heat energy and can thus be employed in smaller cities and populated areas.

This is obviously not an environmentally satisfactory solution. The constantly increasing population and energy consumption of the modern society exerts a growing pollution pressure on the environment. One of the most immediate pollution problems in heavy populated areas is the air quality. Due to extensive use of motorised traffic, heating by wood and fossil fuels, industry, etc. the air in heavy populated areas are often locally polluted by small particles of partly or fully unburned carcinogenic remains of fuels such as soot, PAH; acid gases such as $NO_x$, $SO_2$; toxic compounds such as CO, dioxin, ozone, etc. One has recently become aware of that this type of air pollution has a much larger impact on human health than previously assumed, and leads to many common diseases including cancer, autoimmune diseases and respiratory diseases. The latest estimates for Oslo city, population approx. 500000, is that 400 people die each year due to diseases that can be traced to bad air quality, and the frequency of for instance asthma is significantly larger in heavily than in scarcely populated areas. As a result of this knowledge, there are being raised demands for decreasing the emission permits of the above mentioned compounds.

Thus there is a need for waste incinerators that can operate on smaller waste volumes produced by smaller communities and populated areas with the same level of emission-control as the larger incinerators (>30 MW) with full cleansing capacity, and without increasing the price of heat energy. Typical sizes of the smaller plants are in the range of 250 kW to 5 MW Prior Technology Most incinerators employs two combustion chambers, a primary combustion chamber where moisture is driven off and the waste is ignited and volatilised, and a second combustion chamber where the remaining unburned gases and particulates are oxidised, eliminating odours and reducing the amount of fly ash in the exhaust. In order to provide enough oxygen for both primary and secondary combustion chambers, air is often supplied and mixed with the burning refuse through openings beneath the grates and/or is admitted to the area from above. There are known solutions where the air stream is maintained by natural draft in chimneys and by mechanical forced-draft fans.

It is well known that the temperature conditions in the combustion zone is the prime factor governing the combustion process. It is vital to obtain a stable and even temperature in the whole combustion zone at a sufficient high level. If the temperature becomes too low, the combustion of the waste will slow down and the degree of incomplete combustion will rise which again increases the levels of unburned remains (CO, PAH, VOC, soot, dioxin etc.) in the exhaust gases, while a too high temperature will increase the amount of $NO_x$. Thus the temperature in the combustion zone should be kept at an even and stable temperature of just below 1200° C.

Despite numerous extensive trials of achieving good control of the air flow in the combustion zones, state of the art incinerators do still produce sufficiently high levels of fly ash and the other above mentioned pollutants that the exhaust must be subject to extensive cleansing by several types of emission-control devices in order to reach environmentally acceptable levels. In addition, most conventional incinerators must also employ expensive pre-treatments of the waste fuel in order to upgrade the fuel and thereby reduce the formation of for instance fly ash.

OBJECT OF INVENTION

The main object of this invention is to provide an energy converter plant for solid waste which operates well below the emission regulations valid for incinerators larger than 30 MW with use of only moderate emission-control devices at the exhaust outlet.

It is also an object of this invention to provide an energy converter plant for solid municipial waste which operates in a continuous process on a small scale, in the range of 250 kW to 5 MW and which can produce heat energy in form of hot water and/or steam at the same price level as large incinerators above 30 MW.

A further object of this invention to provide an energy converter plant for solid waste which can operate on small scale in the range of 250 kW to 5 MW and employ all kinds of solid municipal waste, rubber waste, paper waste etc. with water contents up to about 60%, and which can operate with very simple and cheap pre-treatment of the fuel.

SHORT DESCRIPTIONS OF THE DRAWINGS

BRIEF DESCRIPTIONS OF THE INVENTION

Figure 1:
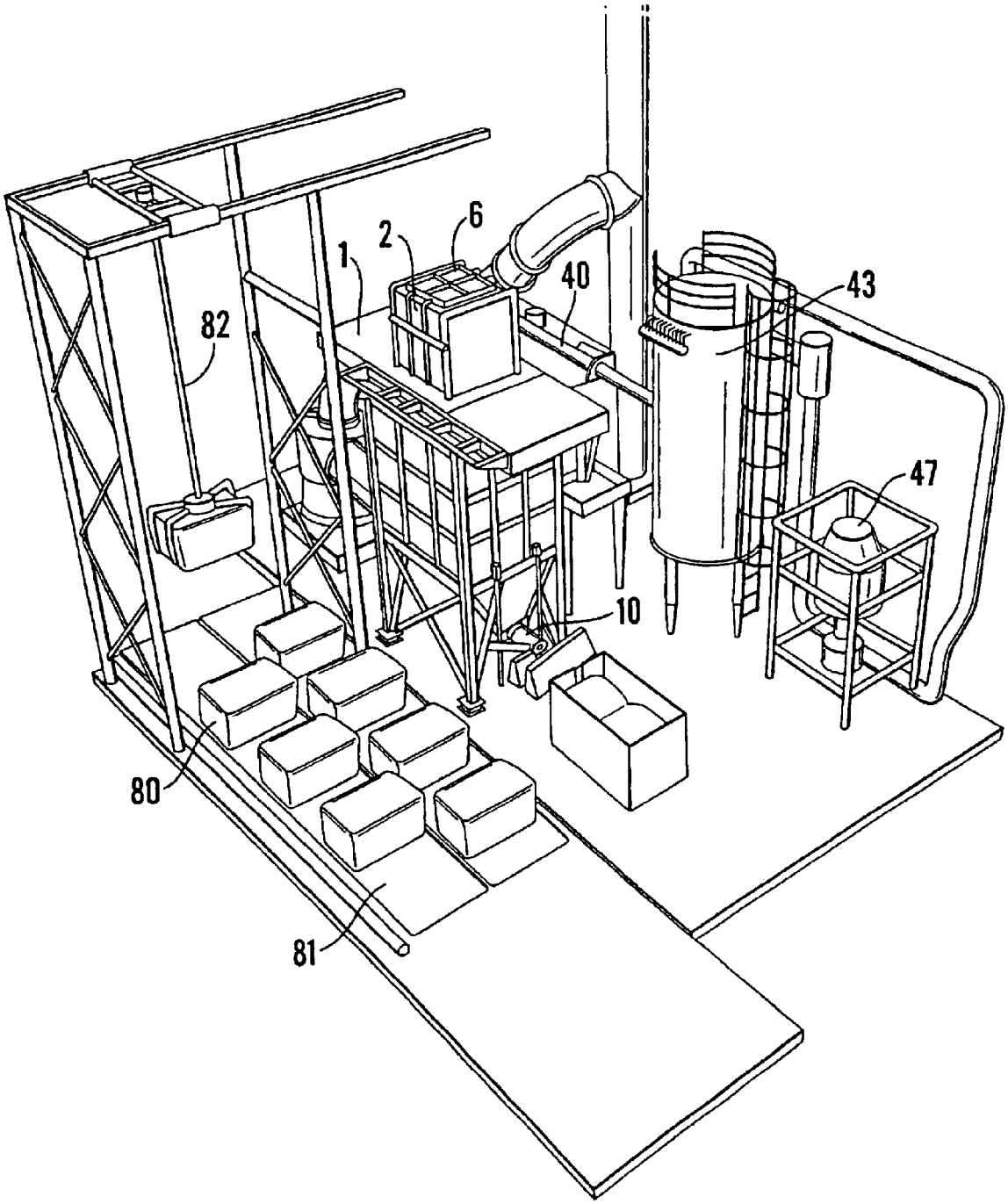
FIG. 1 shows a preferred embodiment of an incineration plant according to the invention seen in perspective from above.

The aims of the invention can be achieved by an energy converting plant according to the following description and appended claims.

The aim of the invention can be achieved by an energy converter for instance an incinerator plant for solid fuels which operates according to the following principles:

1) ensuring a good control of the oxygen flow in the combustion chamber by regulating the flow of fresh air which is led into the chamber in at least one separate zone and by sealing off the entire combustion chamber in order to eliminate penetration of false air into the chamber,
2) ensuring a good control of the temperature in the combustion chamber by admixing a regulated amount of recycled flue gas with the fresh air which is being led into the chamber in each of the at least one separate zones, and
3) filtering both the recycled flue gas and fresh combustion gases in unburned solid waste in the first combustion chamber by sending the unburned solid waste and the gases in a counter-flow before entering the gases into the second combustion chamber.

The combustion rate and temperature conditions in the combustion chamber are largely controlled by the flow of oxygen inside the chamber. It is therefore vital to achieve an excellent control of the injection rate, or air flow velocity of the fresh air which is led into the combustion chamber for all injection points. It is also an advantage to be able to regulate the injection points independently of each other in order to meet local fluctuations in the combustion process. It is equally vital to avoid false air penetration into the chamber since false air gives an uncontrolled contribution to the combustion process, and will normally lead to a less complete combustion and thereby an enhancement of pollutants in the flue gases. The penetration of false air is a common and serious problem in prior art. In this invention the control with false air is solved by sealing off the entire combustion chamber against the surrounding atmosphere and sluicing solid waste into the upper part of the combustion chamber and bottom ash out of the bottom part of the combustion chamber.

In conventional incinerators it is often found that when the content of CO is low in the flue gas, the content of $NO_x$ is high and vice versa, when the content of $NO_x$ is low the content of CO is high. This reflects the difficulties encountered in regulating the temperatures of the combustion zones in conventional incinerators. As mentioned, too low combustion temperatures leads to a lesser degree of complete combustion and larger CO contents in the flue gases, while too high combustion temperatures leads to production of $NO_x$. Thus when the temperature is controlled by just regulating the amount of oxygen (air) entering the combustion zone, it has proven difficult to obtain an adequate and simultaneous temperature control of both the areas adjacent to the oxygen inlets and in the bulk combustion zone. That is, it is difficult to obtain both a sufficient low temperature in the area adjacent to the inlets to avoid $NO_x$-formation and a sufficient high temperature (i.e. combustion rate) in the bulk areas to avoid CO-formation. In prior art, the temperature of the inlet areas will in practise be too high if the temperature of the bulk area is adequate, and if the temperature of the inlet areas is adequate the temperature of the bulk area becomes to low. This problem is solved by the present invention by admixture of recycled inert flue gas which functions partially as a chilling fluid and partially as a thinner which reduces the oxygen concentration in the combustion chamber. Thus it becomes possible to maintain a sufficiently high supply-rate of oxygen to maintain a sufficiently high temperature in the bulk area without overheating the inlet zones. This gives another advantage since the admixture of recycled flue gas and fresh air in the combustion zones make it possible to maintain a rapid over-all combustion rate, i.e. large incineration capacity without danger of over-heating of the combustion zone.

A common problem of incinerators is that the air flow inside the combustion chamber is often sufficiently rapid to entrain and carry along large quantities of particulate matter such as fly ash and dust. This leads, as mentioned, to an unacceptable high content of fly ash and dust in the gas flow in the entire incineration plant and makes it necessary to install extensive cleansing equipment on the exhaust outlet. The problem with fly ash can be considerably reduced/eliminated by filtering the flue and unburned combustion gases in the first combustion zone by sending them in a counter-flow through at least a portion of the unburned solid waste inside the primary combustion chamber. This removes a large portion of the fly ash and other solid particles entrained in the gas leaving the first combustion chamber, and thus from all subsequent combustion chambers of the incinerator plant, and will therefore reduce/eliminate much of the need for cleansing of the exhaust gases. This constitutes a very efficient and cheap solution of the problem with fly ash and other solid particulate materials in the exhaust from incinerators.

Another advantage is that since most of the fly ash is retained in the primary chamber, the plant can operate with less strict demands for pre-treatment of the solid waste. Prior art incinerators have often met the problem of fly ash by efforts to produce less fly ash by pre-treating and/or up-grading the waste by for instance sorting, chemical treatments, adding hydrocarbon fuels, pelletising, etc. For incinerators according to the invention, all these measures are no longer needed. Thus the handling of the solid waste can be made very simple and cost effective. A preferred way is to pack or bale the waste into large lumps which are wrapped in a plastic foil such as a polyethylene (PE) foil. This gives easy to handle and odourless bales which are easy to sluice into the combustion chamber.

DETAILED DESCRIPTION OF THE INVENTION

The invention will now be described in more detail with reference to the accompanying drawings which shows a preferred embodiment of the invention.

Figure 2:
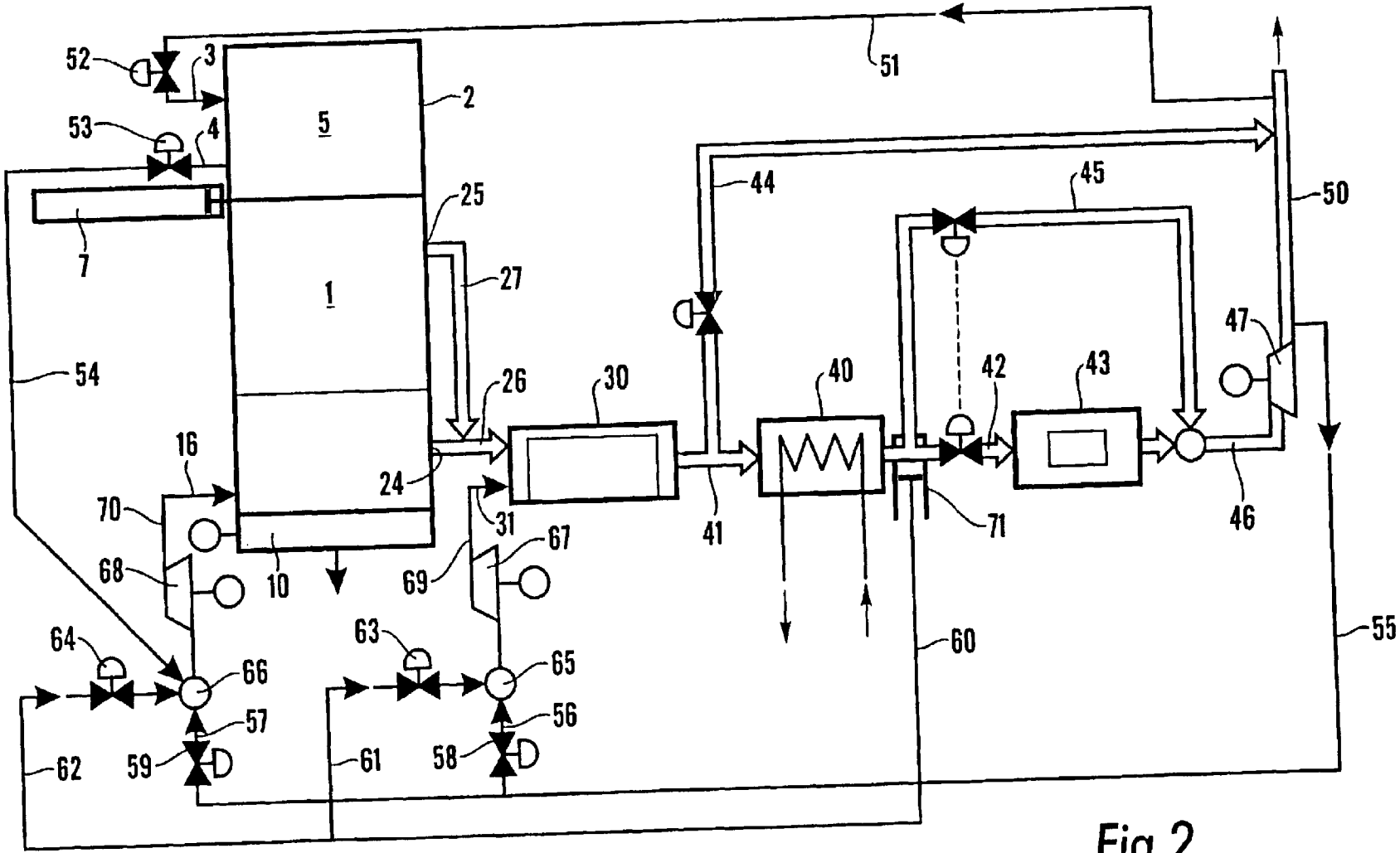
FIG. 2 shows a schematic diagram of the incineration plant shown in FIG. 1.

As can be seen from FIGS. 1 and 2, the preferred embodiment of an incinerator plant according to the invention comprises a primary combustion chamber 1, a secondary combustion chamber 30 with a cyclone (not shown), a boiler 40, a filter 40, a pipe system for recycling and transportation of flue gas, pipe system for supplying fresh air, and means for transporting and inserting the bales of compacted solid waste 80.

Primary Combustion Chamber.

The main body of the primary combustion chamber 1 (see FIGS. 1–3) is shaped as a vertical shaft with a rectangular cross-section. The shaft is given slightly increasing, dimensions in downward direction in order to avoid jamming of the fuel. The upper part of the shaft constitutes an air tight and fireproof sluice 2 for insertion of the fuel in form of bales 80 of solid municipal waste, and is formed by dividing off a section 5 of the upper part of the shaft by inserting a removable hatch 7. The section 5 will thus form an upper sluice chamber confined by the side walls, the top hatch 6 and bottom hatch 7. The sluice chamber 5 is equipped with an inlet 3 and outlet 4 for recycled flue gas. In addition there are a side hatch 8 which acts as a safety outlet in case of unintended violently uncontrolled as generations or explosions in the combustion chamber. The recycled flue gas entering the inlet 3 is taken from the exhaust pipe 50 and transported by pipe 51 (see FIG. 2). The pipe 51 is equipped with a valve 52. The outlet 4 is connected to a by-pass pipe 54 which directs the gas to a junction 66 where it is mixed with recycled flue as and fresh air to be injected into the primary combustion chamber. The functioning of the fuel sluice 5 can be described as follows: First the bottom hatch 7 and valves 52 and 53 are closed. Then the top hatch 6 is opened and a bale 80 of solid waste wrapped in PE-foil is lowered through the top hatch opening. The bale has a slightly less cross-sectional area than the shaft (in both the sluice chamber 5 and combustion chamber 1). After the bale 80 has been placed into the sluice chamber 5, the top hatch 6 is closed and valves 52 and 53 are opened (bottom hatch 7 is still closed). Then recycled flue gas will flow into the empty space in the sluice chamber and ventilate out the fresh air that entered the chamber during insertion of the fuel bale 80. Finally, the bottom hatch 7 is opened to let the fuel bale slide downwards into the combustion chamber 1 and the outlet valve 53 is closed such that the recycled flue gas entering through inlet 52 is directed downward into the combustion chamber. The bottom hatch 7 will continuously try to close the opening, but is equipped with pressure sensors (not shown) that will immediately feel the presence of a waste bale in the opening and retrieve the bottom hatch 7 to the open position. Thus, once the fuel bale has slid to a level just beneath the bottom hatch 7, the bottom hatch will be closed and the sluice process can be repeated. In this way, the fuel is neatly and gently sluiced into the combustion chamber with very little disturbance of the combustion process since the combustion chamber 1 is at any time filled with a continues pile of fuel, and with practically 100% control of false air. This reduces the probability of uncontrolled gas explosions to a minimum. However, in order to break up eventual clogging of solid waste in the primary combustion chamber, the fuel sluice process can be delayed until a specified amount of the solid fuel inside the primary combustion chamber 1 is burnt such that a satisfactory gap is formed. Then the next bale of solid waste will fall onto the bridge/clogging and break it open. This is a very practical solution which can be performed during full operation of the plant within tolerable influences of the combustion process.

Figure 3:
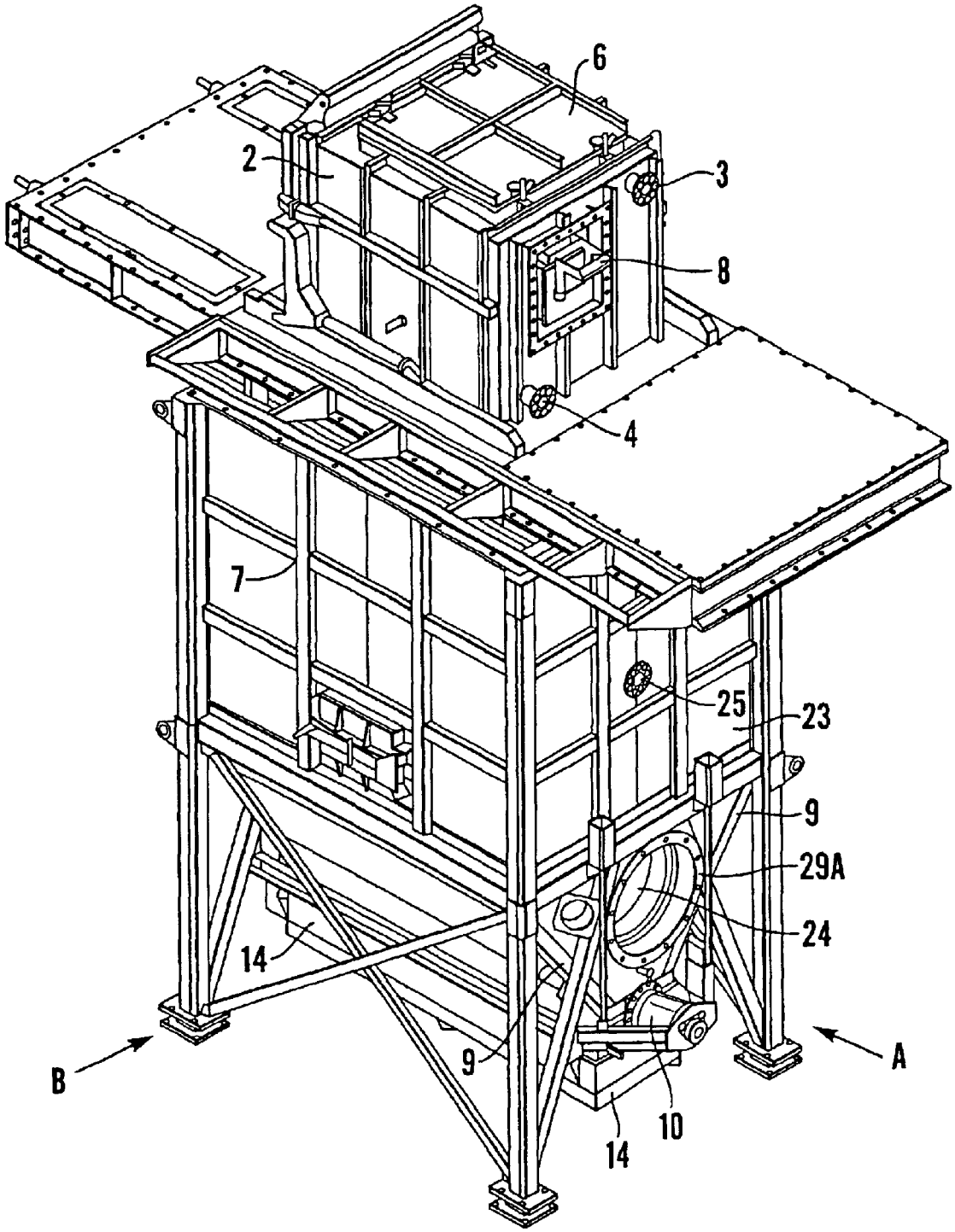
FIG. 3 shows an enlarged drawing of the primary combustion chamber of the incineration plant shown in FIG. 1.
Figure 4:
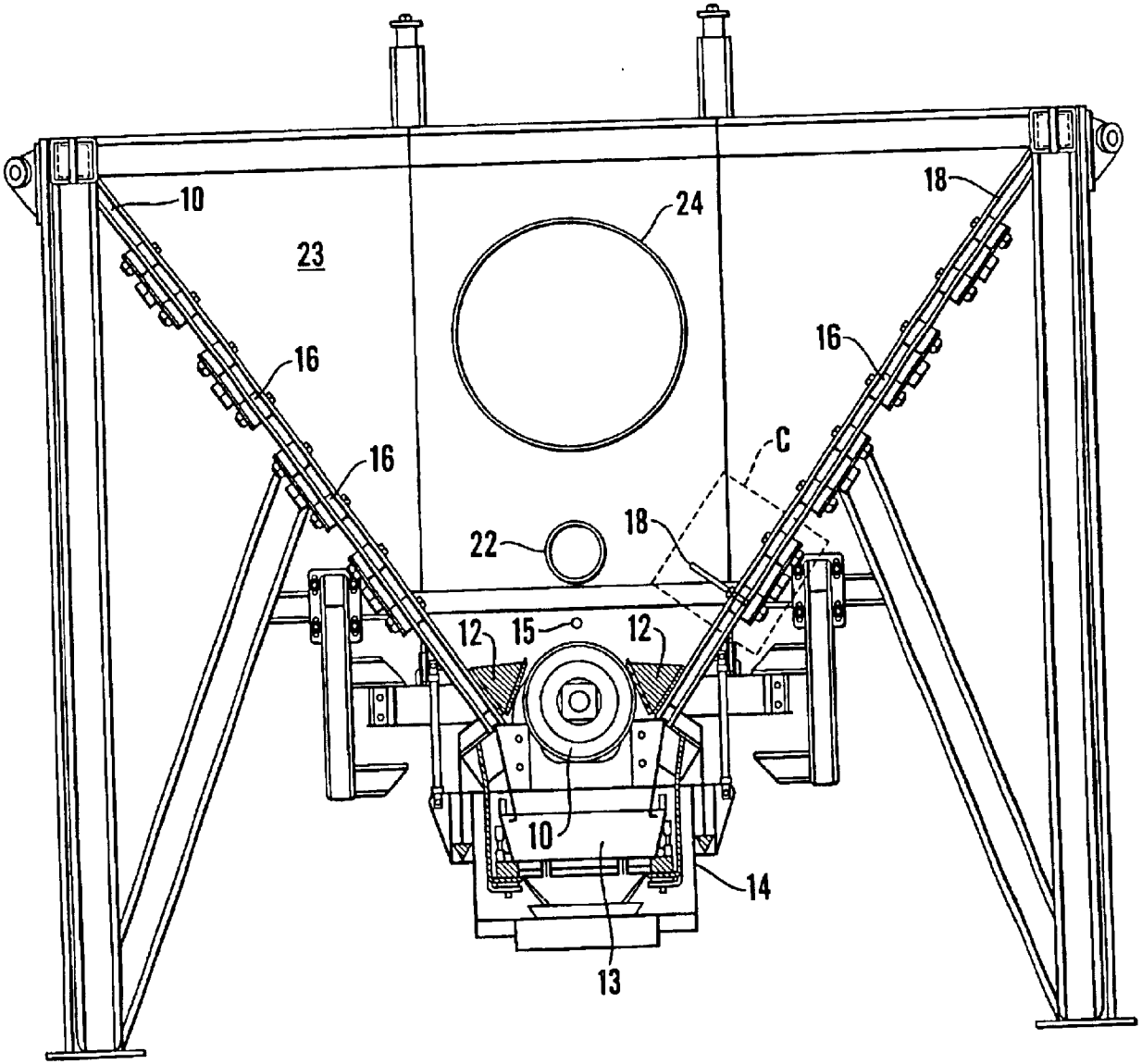
FIG. 4 shows an enlarged side view of the lower part of the primary combustion chamber seen from direction A in FIG. 3.

The lower part of the combustion chamber 1 is narrowed by inclining the longitudinal side walls 9 towards each other, thus giving the lover part of the combustion chamber a truncated V-shape (see FIGS. 3 and 4). A longitudinal, horizontal and rotable cylindrical ash sluice 10 is located in the bottom of the combustion chamber 1 in a distance above the intersecting line formed by the planes of the inclined side walls 9. A longitudinal triangular member 12 is attached to the inclined side wall 9 on each side of the cylindrical ash sluice 10. The triangular members 12 and the cylindrical ash sluice 10 will thus constitute the bottom of the combustion chamber 1 and prevent ash or any other solid matter from falling or sliding out of the combustion chamber. Solid incombustible remains (bottom ash) will therefore build up in the area above the triangular members 12 and the ash sluice 10. The cylindrical ash sluice 10 is equipped with a number of grooves 11 (see FIG. 5) spread out along its perimeter. When the ash sluice cylinder 10 is set into rotation, the grooves 11 will be filled with bottom ash when they are facing the combustion chamber and thereafter emptied when they are facing downwards. Thus the bottom ash will be sluiced out and fall down into a vibrating longitudinal tray 13 located in a parallel distance underneath the ash sluice cylinder 10. In order to ensure an absolute control with false air, the ash sluice 10 and vibrating tray 13 are encapsulated by a mantle 14 which are airtight attached to the lower part of the side walls of the primary combustion chamber 1.

The ash sluice is equipped with command logic (not shown) that automatically regulates its rotation. A thermocouple 15 is attached to the transverse side wall in a distance above the ash sluice 10 (see FIG. 4). The thermocouple continuously measures the temperature of the bottom ash that builds up in the bottom of the combustion chamber 1 and feeds the temperatures to the command logic of the ash sluice 10. The ash sluice cylinder 10 is driven by an electric motor (not shown) which is equipped with sensors for monitoring the rotation of the cylinder 10. When the temperature in the ash is cooled to 200° C., the command logic will start the motor and set the ash sluice 10 into rotation in one optional direction. Since the old cooled bottom ash is removed and replaced by fresher ash, the temperature of the bottom ash will increase as long as the ash sluice is rotating. The command logic will stop the rotation when the ash temperature reaches 300° C. In the case the ash sluice cylinder 10 is halted for instance by lumps of solid remains in the bottom ash which are jammed between the sluice cylinder 10 and a triangular member 12, the command logic will reverse the rotational direction of the ash sluice 10. Then the lump will often follow the rotation of the cylinder 10 until it meets the other triangular member 12 on the opposite side of the cylinder 10. If the lumps get jammed also on this side, the command logic will reverse the rotational direction once more. This reciprocating rotation of the ash sluice 10 will continue as long as necessary. Most cases of lumps in the bottom ash that are to big to be sluiced out, are remains of larger metallic objects in the waste which have become brittle and fragile due to the high temperatures in the combustion zone. Thus the reciprocating motion of the ash sluice 10 will most often grind the lumps into smaller pieces which will be sluiced out of the combustion chamber. This is for instance an effective way of dealing with the steel-cord remains when burning car tyres. In some cases the metallic remains are so massive that they resist the grinding motion of the ash sluice cylinder 10. Such objects must at be taken out of the chamber at regular intervals in order to avoid filling up the combustion chamber with incombustible material. The ash sluice cylinder 10 is therefore mounted resiliently such that it may be lowered either manually or automatically by the command logic in order to remove these solid objects in an efficient and fast manner without interrupting normal operation of the combustion chamber. The means for lowering (not shown) the ash sluice cylinder 10 is of conventional type which is known to a skilled person and need no further description. It should be noted that when the ash sluice cylinder 10 is lowered, the control with false air is still maintained since all auxiliary means for lowering and rotating the cylinder is located within the sealing mantle 14. Thus there will not be any penetration of false air as long as the mantle 14 is closed. In this way, the problem with false air has been practically eliminated with an energy converting plant according to the invention, since both the fuel inlet and ash outlet are sealed off against the surrounding atmosphere.

Figure 5:
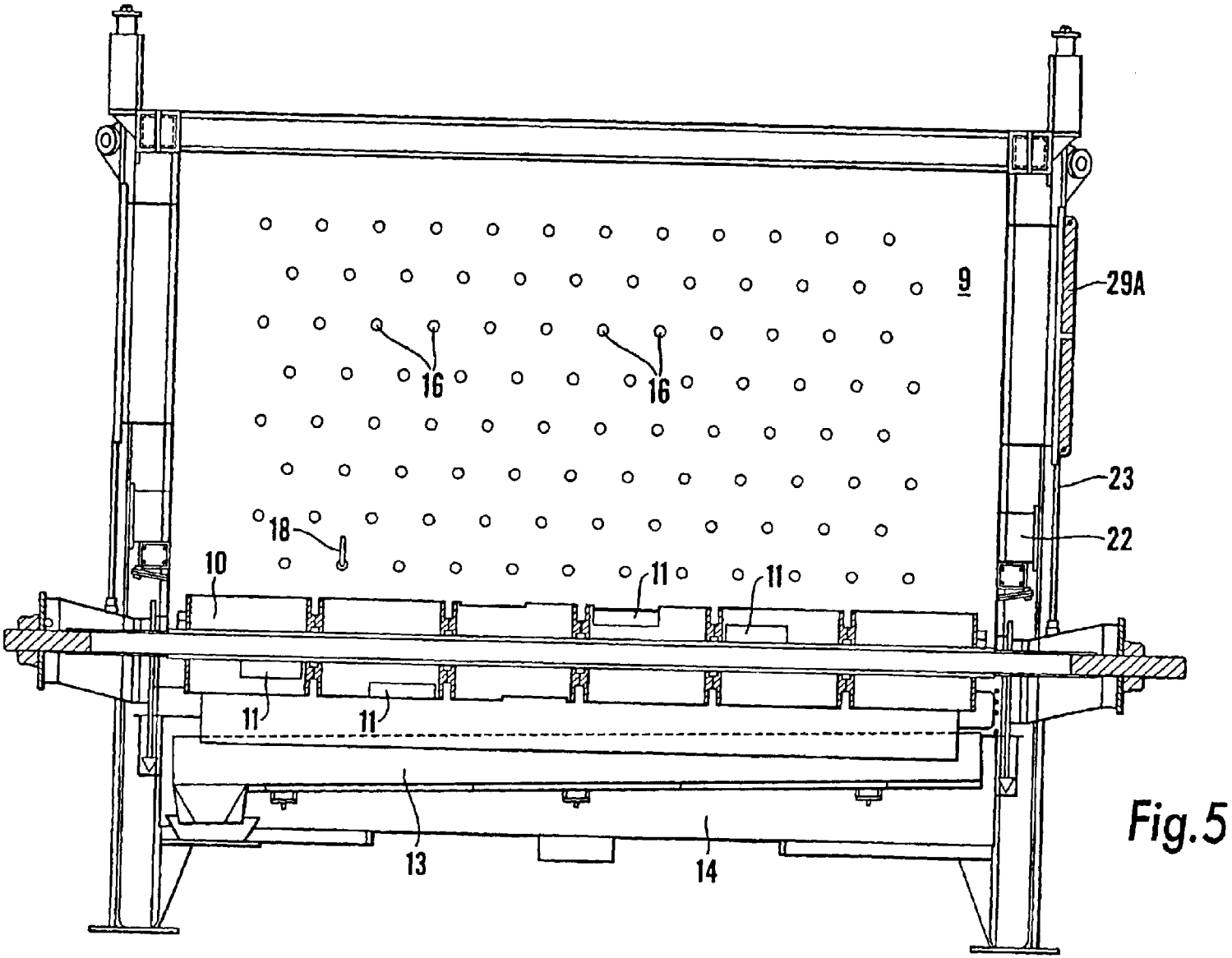
FIG. 5 shows an enlarged side view of the lower part of the primary combustion chamber seen from direction B in FIG. 3.
Figure 6:
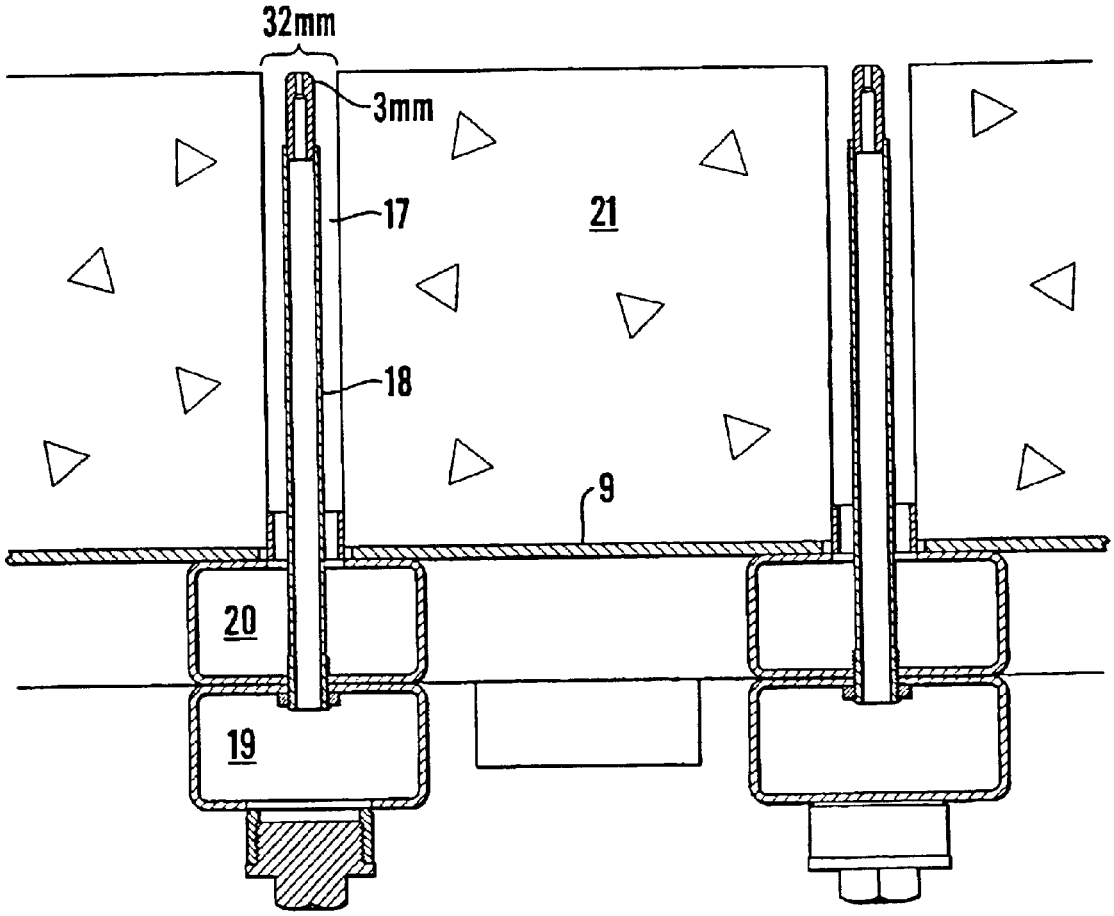
FIG. 6 shows an enlarged cross-section of the inclined side wall marked as box C in FIG. 4. The cross-section is seen from direction A and shows an enlarged view of the inlets for air and flue gas.

The fresh air and recycled flue gas which is entered into the combustion zone are inserted through one or more inlets 16 located on the inclined longitudinal side walls 9 (see FIGS. 4–6). In the preferred embodiment, there are employed 8 rows with 12 inlets 16 on each side wall 9, see FIG. 5. The flue gas is taken from the exhaust pipe 50 and is transported by pipe 55 which divides into one branch 56 for supplying the second combustion chamber 30 and one branch 57 for supplying the primary combustion chamber 1 (see FIG. 2). The fresh air is pre-warmed by means of a heat exchanger 71 which exchanges the heat from the flue gas leaving the boiler 40, and transported through pipe 60 which divides into one branch 61 for supplying the secondary combustion chamber 30 and one branch 62 for supplying the primary combustion chamber 1. Branch 56 and 61 are joined at junction 65 and branch 57 and 62 are joined at junction 66. Further, branch 56 is equipped with valve 58, branch 57 with valve 59, branch 61 with valve 63, and branch 62 with valve 64. This arrangement makes it possible to independently regulate the amount and ratio of fresh air and flue gas which are fed to both combustion chambers 1 and 30 by regulating/controlling the valves 58, 59, 63 and 64 separately. After the pre-warmed fresh air and flue gas are mixed in the junctions 65 and 66, they are sent via pipe 69 to the inlets 31 of the secondary combustion chamber 30 and via pipe 70 to the inlets 16 of the primary combustion chamber 1, respectively. Pipe 69 and 70 are equipped with fans 67 and 68 for pressurising the gas-mixture before insertion into the combustion chambers. Both fans 67,68 are equipped with regulating means (not shown) for regulating/controlling the insertion pressure of the gas-mixture, and they can be regulated independently of each other. In this way the ratio fresh air/flue gas can easily be regulated to any ratio from 0 to 100% fresh air, and the amount of gas-mixture which is inserted into both combustion chambers 1 and 30 can easily be regulated to any amount ranging from 0 to several thousands $Nm^3$/hour.

Returning now to the primary combustion chamber 1. As mentioned, from FIG. 5 it can be seen that the inclined longitudinal side walls 9 are equipped with eight rows each containing twelve inlets 16 in the preferred embodiment of the invention. Referring to FIGS. 4–6, each inlet 16 comprises an annular channel 17 with diameter of 32 mm and a coaxial lance 18 with internal diameter of 3 mm. This gives a cross-sectional area of the annular channel 17 which is approximately 100 times larger than for the lance 18. Thus the pressure also falls with a factor 100. The relatively large cross-sectional area of the annular channel 17 gives a low-pressure inlet stream with low flow velocities, while the narrow lance 18 gives a highly pressurised gas stream with high flow velocities. Further, all annular channels 17 in each row is connected to and extends into (through the inclined side wall 9) one longitudinal hollow section 20 which runs horizontally on the outside of the inclined longitudinal side wall 9. Each annular channel is formed by a circular hole in the fire resistant lining 21 and the lance 18 which is protruding in the centre of the hole. Thus, any as that is fed into one hollow section 20 will run through the annular channels 17 in one row. In addition, we have that two and two rows (hollow sections 20) on each side wall 9 are linked together such that each double-row constitutes one regulation zone. Further, each regulation zone are equipped with regulation means (not shown) for regulating/controlling the as flow and pressure in both hollow sections 20 of each zone. The lances 18 of each row are connected to and extending into a hollow section 19 located on the outside the hollow section 20 in the same manner as for the annular channels 17 (the lance runs through the hollow section 20). The lances 18 are also organised into four regulation zones consisting of two neighbouring rows on each side wall 9. Each regulation zone for the lances are also equipped with means (not shown) for regulating and controlling the gas stream and pressure inside the two hollow sections 19 of each zone. The ratio of gas entering into the combustion chamber 1 through the annular channel 17 and lance 18 can be regulated at any ratio from 0 to 100% through the lance 18 for each regulation zone independently. This arrangement gives the opportunity to freely regulate the gas flow into the primary combustion chamber in four independent zones (the regulation of the gas stream is symmetric above the vertical centre-plane in direction A given in FIG. 3) at any flow rate and with any ratio of the gas-mixture from 100% fresh air to 100% flue gas. For example, when starting up the incinerator, one should establish a controlled and stable combustion zone as soon as possible. This may be achieved by using a gas-mixture which consists of almost pure air and which is led through the lances 18 in order to achieve a relatively violent (as stream in the solid waste in order to achieve a maximal forge effect. At the initiation of the combustion process, the necessary heat energy is delivered by a conventional oil or gas burner 22 located at a distance above the thermocouple 15 on the lateral side wall 23 (see FIG. 4). The burner 22 is only engaged at the initiation and is shut down under normal operation of the plant. At a later stage when the combustion zone is nearly established and the temperatures have reached relatively high levels, the forge effect should be reduced in order to prevent local overheating. This can be achieved by inserting the gas through the annular channels and admix it with flue gas in order to reduce gas flow velocities and diluting the oxygen content in the gas. These features combined with the feature of sluicing fuel in and ash out of the combustion chamber give an excellent control with the oxygen flow in the entire combustion zone and practically eliminates the problem of false air. In addition, the feature of admixing flue gas into the fresh air gives the opportunity to run the incinerator plant with high incineration capacities and relatively high bulk zone temperatures while avoiding overheating any part of the combustion zone. Thus it is possible to run the incineration plant at high capacities with low emission levels of both CO and $NO_x$, in contrast to prior art incinerators. Another advantage with the invention is that the capacity of the incinerator plant can quickly and easily be adjusted to variations in the demand for energy by regulating the total amount of supplied flue gas and fresh air, and by regulating the relative amounts of gas which are inserted into the combustion chamber 1 through each regulation zone. In this way, it becomes possible to maintain the optimal temperature conditions in the combustion zone by adjusting the energy production by regulating the "size" of the combustion zone.

The primary combustion chamber is equipped with at least one, but normally at least two gas outlets. The first outlet 24 is located at a distance above the gas burner 22 on the vertical centre line of the lateral side wall 23, and the second outlet 25 is located on the same lateral side wall 23 in a relatively large distance above the first outlet 24 (see FIG. 3 or 4). The first outlet 4 has a relatively large diameter in order to lead out the combustion gases from the primary combustion chamber 1 with small flow velocities. The small flow velocities give a valuable contribution to the reduction of entrained fly ash in the combustion gases. In addition the fly ash will also be filtered out of the combustion gas during its passing through the solid waste that lies in between the combustion zone and the outlet 24. These effects are sufficient to reduce the content of fly ash in the combustion gases that leaves the primary combustion chamber to acceptable levels when the plant is fed with solid waste of low heat values, even though the outlet 24 is located in a relatively low position of the combustion chamber which means that the combustion gases are filtered through relatively small amounts of solid waste. The upper gas outlet 25 is closed when the lower outlet 24 is employed during incineration of waste with low heat values. The outlet 24 is connected to pipe 26 which leads the combustion gases to the inlet 31 of the secondary combustion chamber 30. In this case the temperature of the combustion gases which leaves the primary combustion zone should be kept in the range of 700–800° C. This temperature is measured at the outlet 24 and fed to the command logic (not shown) which performs the regulation of the gas flow in the primary combustion chamber 1.

In the case of burning waste with high heat values, there will be a much larger gas production in the primary combustion chamber, which results in much larger flow velocities of the combustion gases. This increases the need for filtration capacity of entrained fly ash in the combustion gases. In this case, the outlet 24 is closed by inserting a damper (not shown) and the upper outlet 25 is opened in order to force the combustion gases to run upwards through a major part of the primary combustion chamber 1, and thereby filtrate the combustion gases in a much larger portion of the solid waste in the chamber. The outlet 25 is connected to pipe 27 which directs the combustion gases to the pipe 26. However, due to the prolonged filtration in a larger portion of the solid waste, the combustion gases will be subject to a larger degree of cooling by the solid waste. Thus it may be necessary to ignite the combustion gases flowing in pipe 27 before they enter the secondary combustion chamber 30. This can easily be performed by equipping the damper which seals off outlet 24 with a small hole. Then a flame tongue will protrude from the primary combustion chamber 1 into the pipe 26, and ignite the combustion gases as they pass on their way to the inlet 31 of the secondary combustion chamber 30.

As mentioned, the hot combustion gases from the combustion zone in the primary combustion chamber 1 will pass through unburned solid waste on their way out of the primary combustion chamber. Then the combustion gases will give off heat to the solid waste and preheat it. The degree of preheating will vary from very high in the waste which is adjacent to the combustion zone to much lower for the waste further up in the combustion chamber. Thus the incineration process in the primary combustion chamber is a mixture of combustion, pyrolysis and gasification.

The interior walls of the primary combustion chamber 1, with exception of the ash sluice cylinder 10, are covered by approximately 10 cm of a heat and shock resistant material. It is preferred to employ a material which is sold under the name BorgCast 85 which has a composition of 82–84% $Al_2O_3$, 10–12% $SiO_2$, and 1–2% $Fe_2O_3$.

Even though the invention has been described as an example of a preferred embodiment containing one lower outlet 24 placed in the same height as the upper inlets 16, the invention can of course be realised by incinerators where there may be outlets with other diameters, at other heights, and with more than one outlet in use simultaneously. It is envisaged that in the case of fuels with very high heat values, such as for instance car tyres, the gas flow inside the plant becomes so high that the secondary combustion chamber 30 does not have the necessary capacity to complete the combustion of the gases leaving the primary combustion chamber. In this case the plant may be operated with two secondary combustion chambers attached horizontally side by side and that the primary combustion chamber has two outlets 24 which also are located side by side, that these outlets 24 are closed with dampers containing a small hole each, and that the combustion gas is taken out through outlet 25 which is branched to one supply line 26 for each secondary combustion chamber 30.

The Secondary Combustion Chamber

Figure 7:
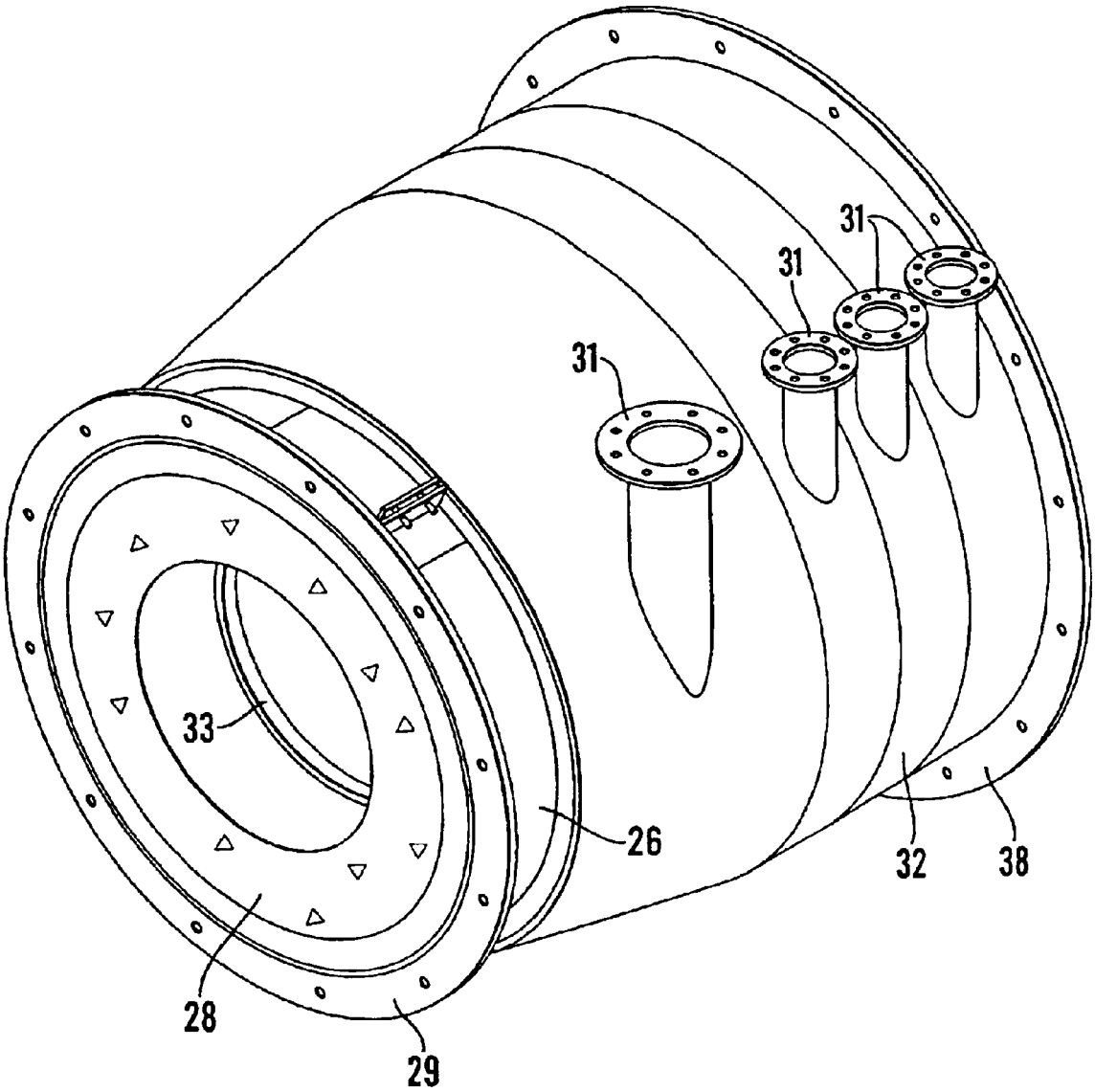
FIG. 7 is a side view of the secondary combustion chamber according to a preferred embodiment of the invention intended for fuel with low heat values.
Figure 8:
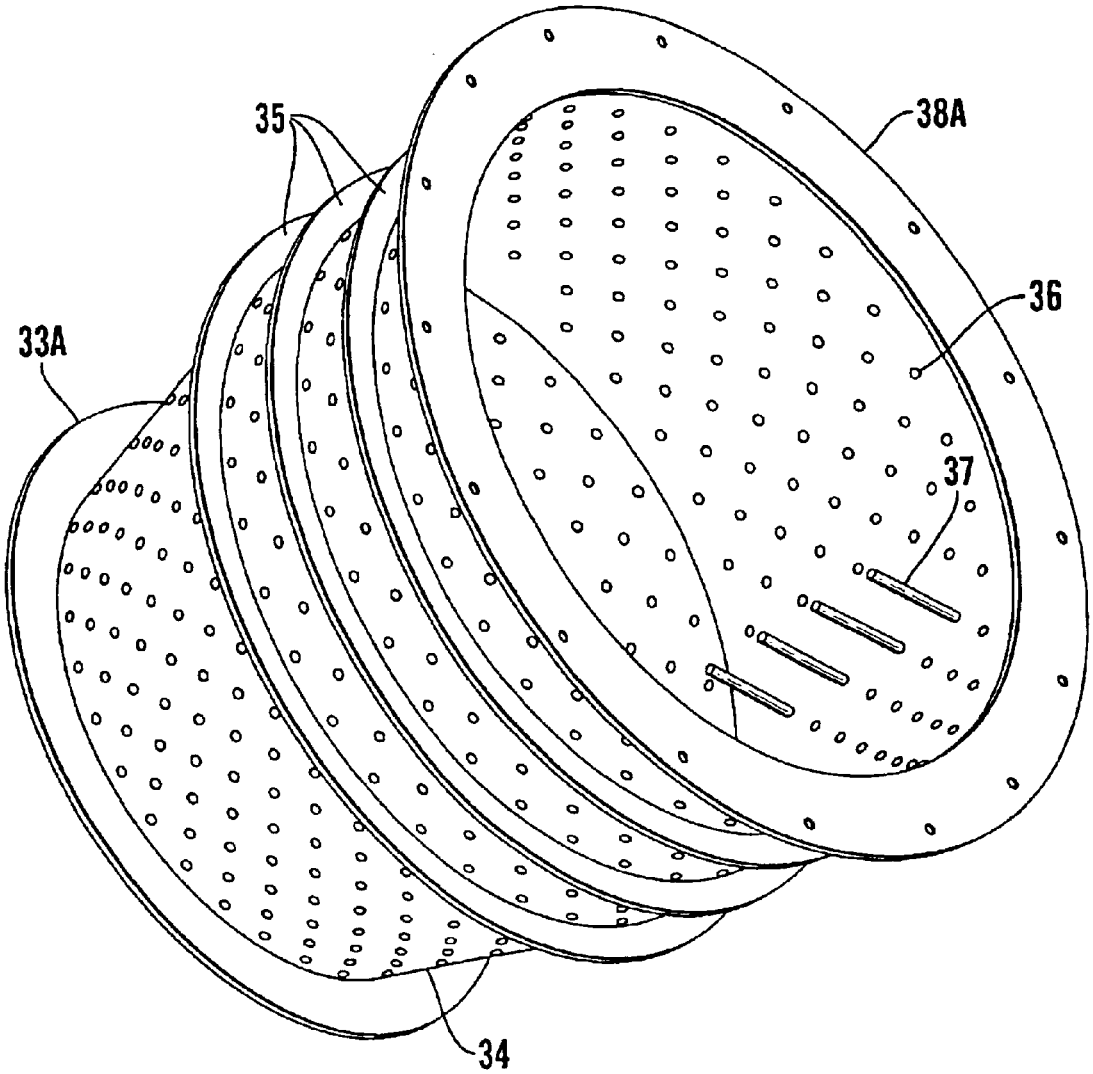
FIG. 8 is an exploded view showing the internal parts of the secondary combustion chamber shown in FIG. 7.

In the case of incinerating fuels with low heat values, it is preferred to employ a secondary combustion chamber 30 as depicted in FIGS. 7 and 8. In this embodiment, the secondary chamber 30 is built in one piece with the pipe 26 which leads the combustion gases from the outlet 24 of the primary combustion chamber 1. The interior of pipe 26 is lined with a heat resistant material 28. The lining has a thickness of approximately 10 cm and a composition of 35–39% $Al_2O_3$, 35–39% $SiO_2$, and 6–8% $Fe_2O_3$. The inlet for the combustion gases into the second combustion chamber is marked by flange 33 on FIG. 7, while the other side of the pipe 26 is equipped with flange 29 which has the same dimensions as the flange 29A on outlet 24 on the primary combustion chamber (see FIG. 3). Thus the pipe 26 and secondary combustion chamber are attached to the primary combustion chamber 1 by bolting flange 29 onto flange 29A.

The secondary combustion chamber is also equipped with inlets 31 for the pressurised gas-mixture of fresh air and recycled flue gas. The preferred embodiment intended for fuels with low heat values, contains four inlets 31 (see FIG. 7). Each of these are equipped with means (not shown) for regulating the gas flow, pressure and fresh air/flue gas ratio in the same manner as each regulation zone of the gas inlets 16 of the primary combustion chamber 1. The secondary combustion chamber 30 consists of a cylindrical combustion casing 32 which is tapered or narrowed towards the inlet 33 for the combustion gases. Thus the combustion chamber is expanded in order to slow down the combustion gases and thereby achieve longer mixing and combustion times in the chamber. Inside the combustion casing 32, there is located a second perforated cylindrical body 34 (see FIG. 8) which is adapted to fit into the combustion casing 32, but with a somewhat smaller diameter than the inner diameter of the combustion casing 32. The cylindrical body is equipped with outwardly protruding flanges 35 which also is adapted to fit within the combustion casing 32 with exactly the same outer diameter as the inner diameter of the casing 32. Thus the flanges 35 will form partition walls which divides the annular space confined by the combustion casing 32 and the perforated cylindrical body 34 into annular channels. In this case there are three partition flanges 35 which divides the annular space into four chambers, one for each gas inlet 31. Thus, the pressurised fresh air and flue gas mixture which is sent through inlet 31 will enter into the annular chamber confined by the partition flanges 35, combustion casing 32 and the perforated cylindrical body 34, and from there flow through the holes 36 into tubes 37 which leads the gas through the lining 28 which covers the interior of the cylindrical body 34 (the lining is not included in the drawing) the interior of the cylindrical body 34 where they are mixed with the hot combustion gases. In this way it is achieved an even and finely divided mixing, of the combustion gases and the oxygen containing gas-mixture in four separately regulated zones. This gives excellent control with the combustion and temperature conditions inside the secondary combustion chamber. The temperature inside the chamber should be kept at approximately 1050° C. It is important to avoid higher temperatures in order to prevent formation of $NO_x$.

A gas cyclone is attached to flange 38 at the outlet of the secondary combustion chamber in order to provide a turbulent mixing of the combustion gases and oxygen containing gases in order to facilitate and complete the combustion process. The cyclone will also help reducing the content of fly ash and other entrained solid particles in the gas flow. The cyclone is of conventional type which is well known for a skilled person, and need no further description.

Figure 9:
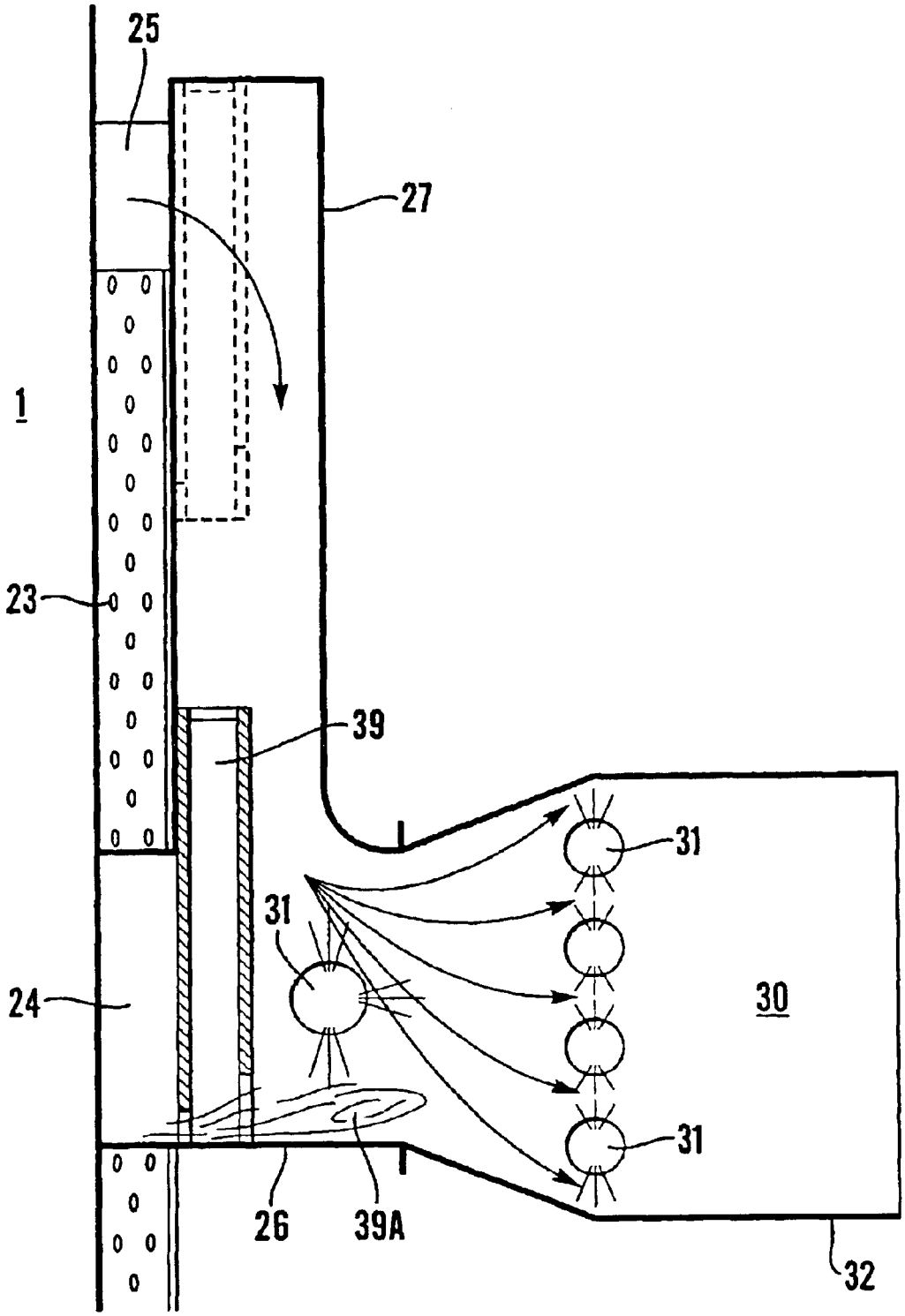
FIG. 9 shows a side view of a second preferred embodiment of the secondary combustion chamber intended for fuels with high heat values.

In the case of incinerating fuels with high heat values, it is preferred to employ a second embodiment of the secondary combustion chamber as depicted in FIG. 9. In this case the combustion gas is taken out from the primary combustion chamber by outlet 25 and transported by pipe 27 down to pipe 26 on the outside of the closed outlet 24. Outlet 24 is closed by a damper 39 which is equipped with a small hole in the lower part, from which a flame tongue 39A protrudes into pipe 26. The secondary combustion chamber 30 is attached to pipe 26, and consist in this case of a cylindrical combustion casing 32 which is tapered towards the pipe 26. In this case there is no internal cylindrical body, instead the inlets 31 consist of perforated cylinders 31 which runs across the interior of the combustion casing 32. From FIG. 8 we see that in the preferred embodiment there are five inlets 31, the first is placed in the pipe 26 and supplies the combustion gases which enters from pipe 27 with the oxygen containing gas-mixture supplied from pipe 69 before the gas mixture is ignited by the flame tongue 39A. Then the gases passes through four inlet cylinders 31 which are aligned on top of each other and receives additional supplies of the oxygen containing gas-mixture. As with the first preferred embodiment, this embodiment does also provide means (not shown) for separate regulation of the gas-mixture composition and pressure for each inlet 31. There is also in this case attached a gas cyclone at the outlet of the combustion chamber, but in this case the gas stream velocities are sufficiently high to give turbulent mixing of the combustion gas and the supplied gas-mixture also in the secondary combustion chamber. The temperatures in the combustion zone should also in this embodiment be kept at approximately 1050° C.

The regulation of the secondary combustion zone are performed by command logic (not shown) which regulates all inlet zones 31. The command logic are continuously fed with the temperature, oxygen content and total amount of the gas which leaves the gas cyclone, and employs the information to regulate the temperature of the flue gas to 1050° C. and a oxygen content of 6%.

Auxiliary Equipment

The combustion gases will be turned into hot flue gases during the stay in the as cyclone. From the gas cyclone the flue gases will be sent to a boiler 40 for transferring their heat energy to another heat carrier (see FIG. 2). Thereafter, the flue gases are transported to a gas filter 43 for additional reduction of fly ash and other pollutants in the flue gas before they are discharged as exhaust gas. Both the boiler 40 and gas filter are equipped with by-pass pipes for the flue gas in order to provide the opportunity to shut-down the boiler and/or filter during operation of the combustion chambers. The gas flow through the plant are governed by the fans for pressurising the inlets to both combustion chambers and by the fan 47 located in the exhaust pipe 50. The latter fan 47 ensures a good draft through the plant by providing a slight suction by lowering the gas pressure. All components of this auxiliary equipment are conventional and well known to a skilled person, and need no further description.

EXAMPLE 1

The preferred embodiment of the invention will now be further illustrated by providing an example of incineration of ordinary municipal waste which is classified in Norway as class C. The waste is considered as a fuel with low heat values. Thus, it is the first preferred embodiment of the secondary combustion chamber which is employed and which is attached to gas outlet 24 of the primary combustion chamber. The upper gas outlet 25 is closed.

The municipal waste is compacted into large bales of approximately 1 $m^3$ volume and then wrapped in PE-foil which are sluiced into the top of the primary combustion chamber through sluice 5 with such a frequency that the primary combustion chamber is at any time filled with solid waste. This is a cost-effective and very simple pre-treatment of the waste compared to the pre-treatments required by conventional incinerators. When the incineration process has been established with a stable combustion zone, the gas-mixture which is led into the primary combustion chamber will be inserted through the annular channels 17 of the inlets 16, and the oxygen content in the gas-mixture will be held at approximately 10%. This concentration will result in an oxygen deficit in the combustion zone. The temperature in the combustion gases that leaves the primary combustion chamber is kept in the range of 700–800° C., and the gas pressure inside the primary combustion chamber is kept at approximately 80 Pa below the surrounding atmospheric pressure. The oxygen content in the gas mixture which is led into the secondary combustion chamber 30, through inlets 31, is regulated such that the total gas flow is approximately 2600 $Nm^3$/MWh, has a temperature of approx. 1050° C., and an oxygen content of approx. 6%. The pressure within the secondary combustion chamber is kept at approx. 30 Pa below the pressure in the primary combustion chamber. In order to ensure that the dioxin and furane emissions are kept at extremely low levels, there is a possibility of adding an adsorbent to the flue as immediately after it leaves the boiler 40 and enters into the filter 43. These features are not shown figures or discussed in the previous discussion, since the method and means for performing this also are conventional and well known to a skilled person. A preferred adsorbent is a mixture of 80% lime and 20% activated carbon, and is supplied in an amount of approximately 3.5 kg per tonne fuel.

With the above parameters, the incineration plant was tested by the Norwegian classification and verification firm, Det Norske Veritas. The energy production was approx. 2.2 MW. The content of fly ash and other pollutants in the flue gas leaving the plant was measured and is given in Table 1 along with the official emission limits for each constituent. The official emission limits are given for both the presently valid limits for existing incineration plants and the future limits as proposed in a EU draft "Draft Proposal for a Council Directive on the Incineration of Waste" dated Jun. 1, 1999.

From Table 1 it can be seen that the preferred embodiment of the invention achieves emission values which are very comfortably below most official limits valid for present incinerators, by a factor of at least 10 below the limits. Even most of the future EU limits, which are considered to be very strict, will pose no problem with the possible exception of $NO_x$, where the value was just below the limit. All other parameters are very comfortably below the future limitations as well.

TABLE 1

| | | Official emission limits | |
|---|---|---|---|
| Compound | Results | Present | Future EU |
| Dust | 3 | 30 | 10 |
| Hg | 0.001 | 0.1 | 0.05 |
| Cd, Tl | 0.004 | | 0.05 |
| Sb, As, Pb, Cr, Co, Cu, Mn, Ni, V | 0.03 | | 0.5 |
| Cd | 0.001 | 0.1 | |
| Pb, Cr, Cu, Mn | 0.03 | 5 | |
| Ni, As | 0.002 | 1 | |
| HCl | 5 | 50 | 10 |
| HF | <0.1 | 2 | 1 |
| $SO_2$ | 1 | 300 | 50 |
| $NH_3$ | 2 | — | — |
| $NO_x$ in form of $NO_2$ | 170 | — | 200 |
| CO | 1 | — | 50 |
| TOC | 1 | 20 | 10 |
| Dioxins and furanes | 0.0001 | 2 | 0.1 |

Measured emission when incinerating municipal waste of Norwegian grade C. The emission is compared to present and future official emission limits in EU. All units are in mg/$Nm^3$ v/11% $O_2$, with exception of dioxins and furanes which is in ng/$Nm^3$ v/11% $O_2$.

The plant has recently been modified such that also the $NO_x$-concentration in the flue gas leaving the gas cyclone is measured along with the oxygen concentration, temperature and flow velocity, and is fed to the command logic that regulates the inlets 31 of the secondary combustion chamber 30. The command logic is given liberty to vary the oxygen concentration within the range of 4 to 8%. All other parameters are left unaltered. With this modification, test runs have shown that the $NO_x$-emissions are typically about 100 mg/$Nm^3$ v/11% $O_2$, but has reached levels down to 50 mg/$Nm^3$ v/11% $O_2$. The other pollutants presented in Table 1 were not affected by this modification.

It should also be noted that if the flue gases are emitted without treatment with the adsorbent, the emission levels of dioxins and furanes will be in the order of 0.15–0.16 ng/$Nm^3$ v/11% $O_2$, which are well below the present emission limits. Thus the present invention can presently be employed without this feature.

EXAMPLE 2

In order to make the preferred embodiment of the invention as given above suited for handling toxic or any other form of special waste where the ash should be given a separate treatment than the ordinary ash from municipal waste, it is envisioned to include a pyrolysis chamber located in the flue gas stream exiting the second combustion chamber 30. There the flue gases will have a temperature of 1000–1200° C. which is sufficiently high to decompose most organic and many inorganic compounds. The pyrolysis chamber and design of the flue gas pipe 41 containing the pyrolysis chamber is conventional and well known for a skilled person and need therefore no further description.

A separate pyrolysis chamber makes is possible to sort out special waste from the bulk waste stream and decompose it in the pyrolysis chamber, such that the ash from the special waste can be separated from the ash of the bulk part of the waste and thus avoid that the bulk volume of ash must be treated as special waste. This is beneficial for cases where the special waste is toxic, for cremation of pets or other applications where the ash must be traceable etc.

The vapours and gases from the pyrolysis chamber may subsequently be led to the primary combustion chamber and thus enter the main flow of combustion gases.

What is claimed is:

1. Method for converting by incineration the energy content in solid waste to other energy carriers, where the incinerator comprises a primary and at least one additional combustion chamber in which the primary combustion chamber incinerates the solid waste while the at least one additional combustion chamber finishes the combustion process by combusting the combustion gases exiting the first combustion chamber, characterised in that the oxygen flow in the primary and at least one additional combustion chambers are strictly controlled by separately regulating the flow of fresh air into each combustion chamber in at least one separately regulated zone and by ensuring that the entire combustion chambers are gas tight towards the surrounding atmosphere in order to eliminate penetration of false air into the chambers, that the temperatures in the primary and the at least one additional combustion chamber are strictly controlled, in addition to the regulation of the oxygen flow, by admixing a regulated amount of recycled flue gas with the fresh air which is being led into each of the chambers in each of the at least one separately regulated zones, that the gases which leave the combustion zone in the primary combustion chamber are led through at least a portion of the primary combustion chamber's content of solid waste before the gases exit the primary combustion chamber, and that there is employed a primary 1 and a secondary 30 combustion chamber, and that the regulation of the amount oxygen and the degree of admixture with recycled flue gas is performed in at least two independent inlets 16 or 31, or in at least two independent groups of inlets 16 or 31 of the primary combustion chamber 1 and the secondary combustion chamber 30, respectively.

2. Method according to claim 1, characterised in that the regulation of the amount oxygen and the degree of admixture with recycled flue gas is performed in four independent groups of inlets 16 or 31 of the primary combustion chamber 1 and the secondary combustion chamber 30, respectively.

3. Method according to claim 2, characterised in that primary combustion chamber is fuelled with municipal solid waste which is compacted and wrapped in a plastic-foil to form odour-less bales.

4. Method according to claim 2, characterised in that the primary combustion chamber is fuelled with untreated municipal solid waste, the concentration of $No_x$ in the flue gas leaving the second combustion chamber 30 is monitored, and the admixture and amount of fresh air and recycled flue gas that is inserted into the secondary combustion chamber 30 is additionally regulated by allowing the average surplus of oxygen in the flue gases which leaves the secondary combustion chamber to vary in the range from 4 to 8 vol % while keeping the temperature and total gas flow as in claim 2, with the aim to minimise the content of $No_x$ in the flue gas.

5. Method according to claim 1, characterised in that primary combustion chamber is fuelled with municipal solid waste which is compacted and wrapped in a plastic-foil to form odour-less bales.

6. Method according to claim 5, characterised in that the solid waste in the form of bales 80 is sluiced in an air-tight manner into the primary combustion chamber 1 by a sluice 5, and that the bottom ash is sluiced out of the primary combustion chamber through a sluice 10 which is encapsulated and sealed off by a mantle 14.

7. Method according to claim 1, characterised in that when a stable combustion zone in the primary combustion chamber 1 is achieved when burning wastes with low heat values, that the admixture and amount of the fresh air and recycled flue gas which is led into the primary combustion chamber 1 is regulated to achieve an average concentration of 10 vol % oxygen of the admixed inlet gases and a temperature in the range of 700 to 800° C. of the combustion gases which leave the primary combustion chamber, and that the admixture and amount of fresh air and recycled flue gas that is led into the secondary combustion chamber 30 is regulated to gain an average surplus of oxygen of 6 vol %, a temperature of 1050° C., and a total gas flow of approx. 2600 $Nm^3$/MWh of the flue gases which leaves the secondary combustion chamber.

8. Method according to claim 1, characterised in that the primary combustion chamber is fuelled with untreated municipal solid waste, the concentration of $No_x$ in the flue gas leaving the second combustion chamber 30 is monitored, and the admixture and amount of fresh air and recycled flue gas that is inserted into the secondary combustion chamber 30 is additionally regulated by allowing the average surplus of oxygen in the flue gases which leaves the secondary combustion chamber to vary in the range from 4 to 8 vol % while keeping the temperature and total gas flow as in claim 1, with the aim to minimise the content of $No_x$ in the flue gas.

9. Method according to claim 1, characterised in that the secondary combustion chamber 30 is equipped with at least one gas cyclone in order to turbulently mix the combustion gases with the injected gas-mixture of recycled flue gas and fresh air and thereby achieve a complete combustion of the combustion gases.

10. Method according to claim 1, characterised in that the vapours and gases from the pyrolysis chamber may subsequently be led to the primary combustion chamber and thus enter the main flow of combustion gases.

11. Device for converting by incineration the energy of solid waste to other energy carriers, where the device comprises at primary combustion chamber connected to at least one additional combustion chamber, at least one cyclone, a unit for transferring the heat energy of the flue gases to another heat carrier, a gas filter, a transport system for supplying and admixing fresh air and recycled flue gas to combustion chambers, characterised in that the primary combustion chamber 1 is designed as a vertical shaft with a rectangular cross-section and which is narrowed by inclining the lower part of the longitudinal side walls 9 towards each other to give the lower part of the shaft a truncated V-shape, that the upper part of the shaft constitutes an air-tight sluice 5 for sluicing in the fuel in form of bales 80 of compacted solid waste, that the truncated V-shape of the inclined longitudinal side walls 9 ends in an ash sluice 10 for removal off bottom ash, that the ash sluice 10 is sealed off toward the surrounding atmosphere by an air-tight mantle 14 connected to the vertical shaft, that each of the inclined longitudinal side walls 9 are equipped with at least one inlet or interconnected groups of inlets 16 for insertion of the admixed fresh air and recycled flue gas mixture, and that at least one lateral side wall 23 of the vertical shaft is equipped with at least on outlet 24 or 25 for the combustion gases that forms in the primary combustion chamber, that at the at least one inlet or interconnected group of inlets 16 is equipped with means for separately regulating the total gas flow and degree of admixture of fresh air and recycled flue gas through each inlet or interconnected group of inlets, that at least one outlet 24 is connected to an additional combustion chamber 30, that the at least one additional combustion chamber 30 is equipped with at least one inlet 31 for injection of the admixed fresh air and recycled flue gas mixture, and that each of the at least one inlet 31 is equipped with means for separately regulating the total gas flow and degree of admixture of fresh air and recycled flue gas.

12. Device according to claim 11, characterised in that when the incineration is fuelled by solid waste with low heat values, there is employed one additional combustion chamber 30 which is attached directly to one outlet 24 of the primary combustion chamber, and that the secondary combustion chamber comprises a cylindrical combustion casing 32 and an adapted perforated cylindrical body 34 which is inserted into the casing 32, and which equipped with at least one outwardly protruding flange 35 such that the cylindrical body 34 and casing 32 form annular channels which ale connected to the inlets 31.

13. Device according to claim 12, characterised in that there is employed more than one secondary combustion chambers which each are connected to an outlet 24 via a pipe 26, and that all pipes 26 are connected to the outlet 25.

14. Device according to claim 11, characterised in that when the incineration is fuelled by solid waste with high heat values, in that there is employed an additional combustion chamber 30 which is connected to the outlet 24 through a pipe 26, that the outlet 24 is sealed by a damper 39 which is equipped with a small hole such that a flame tongue is protruding into the pipe 26, that the combustion gases are led from the primary chamber through outlet 25 in the upper part of the primary combustion chamber and into pipe 26, and that the secondary combustion chamber 30 comprises a cylindrical casing 32 which is equipped with at least one transverse running perforated cylinder which constitutes the inlet 31.

15. Device as in one of claims 11–14, characterised in that the ash sluice 10 is shaped as a horizontally longitudinal cylinder located in-between a triangular longitudinal member 12 at the lower end of each of the inclined side walls 9, and that the cylinder is equipped with at least one groove 11 such that the bottom ash is sluiced out when the cylinder 10 is rotated.

16. Device according to claim 15, characterised in that the means for measuring the temperature of the combustion gas exiting the primary combustion chamber is connected to means for regulating the admixture and gas flow of the mixed fresh air and recycled flue gas which is inserted through the at least one inlet 16, and that the means for measuring the temperature, gas flow, oxygen content and Nox-content in the flue gas exiting the secondary combustion chamber is connected to means for regulating the admixture and gas flow of the mixed fresh air and recycled flue gas which is inserted through the at leat one inlet 31.

17. Device as in one of claims 11–14, characterised in that each active outlet from the primary combustion chamber is equipped with means for measuring the temperature of the combustion gases exiting the primary combustion chamber, and that the outlet from each of the at least one additional combustion chamber is equipped with means for measuring the total gas flow, temperature, oxygen content, and $No_x$ content of the flue gas exiting the at least one additional combustion chamber.

18. Device according to claim 11, characterised in that a pyrolysis chamber for decomposing of special waste is located in pipe 41 for leading flue gas exiting the second combustion chamber 30 to boiler 40.

* * * * *